United States Patent [19]

Shann

[11] 4,391,195

[45] Jul. 5, 1983

[54] DETONATION OF EXPLOSIVE CHARGES AND EQUIPMENT THEREFOR

[76] Inventor: Peter C. Shann, 4, Orchard Way, Dringhouses, York, England

[21] Appl. No.: 179,153

[22] Filed: Aug. 18, 1980

[30] Foreign Application Priority Data

| | | | |
|---|---|---|---|
| Aug. 21, 1979 | [GB] | United Kingdom | 7929128 |
| Aug. 21, 1979 | [GB] | United Kingdom | 7929129 |
| Oct. 20, 1979 | [GB] | United Kingdom | 7936504 |

[51] Int. Cl.[3] ..... F42B 3/10

[52] U.S. Cl. ..... 102/201

[58] Field of Search ..... 102/201

[56] References Cited

U.S. PATENT DOCUMENTS

| | | | |
|---|---|---|---|
| 3,362,329 | 1/1968 | Epstein | 102/201 |
| 3,408,937 | 11/1968 | Lewis et al. | 102/201 |
| 3,528,372 | 9/1970 | Lewis et al. | 102/201 |
| 3,618,526 | 11/1971 | Baker | 102/201 |
| 3,812,783 | 5/1974 | Yang et al. | 102/201 |

OTHER PUBLICATIONS

*The Condensed Chemical Dictionary;* Eighth Edition; Van Nostrand Reinhold Company; p. 319.

*Primary Examiner*—Charles T. Jordan

*Attorney, Agent, or Firm*—A. W. Breiner

[57] ABSTRACT

Explosive charges for blasting purposes are actuated by a system of optical fibres supplied with energy from a laser. The laser energy output is substantially in excess of that required for detonation and does not need to be preserved in coherent form, enabling transmission to be via optical fibres and connecting and/or distributing devices of quality or properties unsuitable for data transmission. Simple intermittently driven mechanical arrangements can be used for the sequential firing of a set of charges. Connection to detonators can be by expendable lengths of fibre fed from a main optical channel via simple, economic, plug-and-socket arrangements. The detonators, or components containing flashing composition coating the end of the expendable fibre, may be supplied with an attached fibre ready connected to an expendable optical plug. The connection of the laser with an optical cable, terminating in optical socket arrangements may be by a simple lens arrangement, uneven distribution of energy between the individual fibres being well tolerated.

36 Claims, 27 Drawing Figures

PLUGS
313
312
311
318
A1
B1
C1
N1
EXPLOSIVE CHARGES
314
326
317
318
313
312
311
314
312
315
317
SOCKETS
LASER SOURCE
316

PLUGS
A2
B2
C2
N2
EXPLOSIVE CHARGES
313
312

PLUGS
A3
B3
C3
N3
EXPLOSIVE CHARGES
313
312
313
311

DETONATION OF EXPLOSIVE CHARGES AND EQUIPMENT THEREFOR

The present invention relates to the detonation of explosive charges and has as an object the provision of a system for connection of a set of explosive charges with a laser for detonation thereby.

In accordance with the present invention there is provided a system for connecting a set of explosive charges with a laser for detonation thereby which comprises an input for energy produced by the laser, a set of optical fibres for connection one with each of the charges and distributor means for distributing energy from the input to the fibres of said set, said distributor means being, when simultaneous detonation of charges is required, in the form of one or more branching connections for connecting a fibre fed from said input with two or more fibres of said set or, when sequential detonation of charges is required, in the form of an intermittently actuated mechanical drive to connect members of said set sequentially with said input, said distributor being located at said input or connected with said input by an optical fibre so that the distribution is effected at said input or at a position remote from said input as the case may be.

The detonation of an explosive charge via an optical fibre linkage connected with a laser is an attractive alternative to electrical detonation. As is well understood, the electrical detonation systems require precautions to prevent detonation by spurious currents, for example currents picked up from ground in the neighbourhood of an electrical plant, currents produced by electric storm weather systems and radio frequency currents induced by radio transmissions. In the application of the present system, the amount of energy which can reach the charges other than from the laser is well below that required for detonation.

At the transmission distances required in practice, the distribution means aforesaid operates to detonate the charges reliably, even though neither branching connectors nor mechanically driven distributors can be expected to divide their inputs to provide equal outputs or to function in a loss-free manner.

It is unnecessary, the requirement being merely to supply appropriate amounts of energy to the charges, to ensure that the transmission time between the laser and a charge is constant for the whole of the energy. Multiple path propagation produced by irregular reflections or otherwise by the geometry of the parts is unobjectionable. Satisfactory results and simplicity of design are obtained when the distributor means is operable to supply at least a non-axial direction or directions so that the propagation of the energy through the fibres is by one or more zig-zag paths. The requirements are to be contrasted with those for communication purposes.

For simplicity of construction, and convenience of operation, the optical fibres of the set are preferably connected with the distributor by means of plug connections.

In a preferred arrangement the distributor means incorporates a branched member formed of material which is transparent to the energy, said member having an input section which branches to provide two or more output sections and the arrangement being such that energy from the input section is intercepted by and transmitted along the output sections. Plug connections may be provided for the input section and the output sections. Satisfactory results are obtained if the interception of the energy or its transmission through the plug connections is incomplete or, indeed, if part of the energy is reflected back along the incoming fibre.

The intermittent mechanical drive for the optical distributor may be solenoid actuated. In one preferred arrangement the intermittent mechanical drive and the laser are synchronised so that members of said set are connected with said input in a sequence such that they receive successive pulses from the laser in turn.

Various forms of mechanically driven optical distributors may be employed. One preferred form is a driven rotor having an optical path leading from an axially positioned input to an eccentrically positioned output, and output connections positioned to communicate with said output in turn as the rotor is rotated. This form of distributor lends itself to compact construction and is especially useful for installation at a distance from the laser, for which purpose it may be provided with a fibre input.

Another preferred form of mechanically driven optical distributor has a set of optical outputs mounted by a movable member which is movable to align said outputs successively with an optical input. This form is primarily intended for direct feeding by the laser. For compactness of construction, and to enable the distributor to function with a movement of the movable member substantially less than the space occupied by the set of outputs, the movable member desirably has a set of optical pathways which diverge from one another in the direction of the optical outputs.

Another preferred form of mechanically driven optical distributor has a mechanically movable member operable, on its mechanical movement, to deflect laser energy by reflection or refraction from a fixed input to a plurality of fixed outputs in turn.

Connection of the optical fibres with the explosive charges may be achieved in a very simple manner. Their ends may simply be embedded directly in the charges themselves or may be coated with explosive material. Providing ends with a coating of explosive is preferred in that it avoids the need to make a close working contact at the site. It also enables the explosive in contact with the fibres to be formulated as desired, eg. the explosive coating may contain a pigment of dyestuff to promote absorption of energy from the laser with which it is to be used. The explosive in communication with the fibres is preferably a secondary explosive which may indeed be identical with the explosive of the charges themselves. In this case, the avoidance of detonating material adds to the safety of the system.

Provision may be made for testing the system for optical continuity without danger of detonating the charges since the optical power output of an incandescent lamp or other non-laser source is normally too small to initiate explosions. In accordance with a preferred feature of the invention, the optical fibres have their terminal ends in communication with a phosphorescent material positioned to receive and be actuated by optical energy received through the fibres. To test the system, it is only necessary to check the receipt of the phosphorescent output at the laser position. For this purpose, the phosphorescent material may be activated by light passed through the system as a preliminary to testing. Alternatively or additionally, the making of connections with the charges may be watched from the laser site whilst the phosphorescent material is still activated from ambient illumination at the positions of the charges.

The invention further provides a system for detonating a set of spaced-apart explosive charges which comprises an optical cable having a number of optical fibres extending through the cable from an input to the cable to an output from the cable and diverging from one another at the output for connection with separate ones of the spaced-apart charges, the fibres at the input having input ends positioned together in a reception zone and a laser apparatus for providing a laser beam distributed over the reception zone, the arrangement being such that the part of the laser energy of the beam intercepted by the input end of each fibre is sufficient for the detonation of its associated charge.

Distributing the laser beam over the input ends of the fibres in the reception zone leads inevitably to wastage of the energy from the laser. A portion of the beam is unavoidably directed between the fibres and ensuring that each fibre receives a useful share of the energy normally involves directing another portion of the beam outside the zone occupied by the ends. Even so it is a simple matter to provide a laser of such pulse power that an amount of energy adequate for reliable detonation is supplied to a useful number of charges by the system of the invention. This remains true even though the cable may contain unused fibres, some at least of which terminate in the reception zone and receive a share of the energy.

It is unnecessary, the requirement being merely to supply appropriate amounts of energy to the charges, to ensure that the transmission time between the laser apparatus and a charge is constant for the whole of the energy supplied to that charge. Multiple path propagation produced by irregular reflections or otherwise is unobjectionable. Satisfactory results and simplicity of design are obtained with simple optical arrangements for distributing the laser beam over the reception zone. A lens for converging the beam upon the ends of the fibres is preferred; instead there may be provided a concave mirror or a tube having an appropriate longitudinally decreasing transverse cross section and a reflective inner surface. It is to be observed that the requirements are to be contrasted with those for communication purposes.

The number of charges to be detonated by the system can be expected to vary from one operation to another and it is convenient to employ cable having sufficient fibres for connection with the largest likely number. Thus the number of fibres exceeds the number of charges in many operations. Another case in which the number of fibres can exceed the number of charges is when the cable employed was manufactured for other purposes, eg. communication purposes. In either case there will be unused fibres unless a plurality of fibres is used for connection with one or more of the charges. Where the number of unused fibres is large, the fibres used may be selected so that their input ends form a compact group at the input to the cable.

A cable having more fibres than the number of charges, and arranged so that at least some of the charges are connected with the input by more than one fibre, gives improved reliability of detonation. Broken fibres and any failure to supply adequate laser energy to a particular fibre are better tolerated. The input ends of the fibres associated with a single charge may be distributed over a cross section of the cable at the input or may be grouped together at the input. Grouping the input ends together is the more simple arrangement.

According to a preferred arrangement, the laser apparatus and the cable are interconnectable by a pair of complementary members of the plug and socket type, one mounted on the laser apparatus and the other on the cable. Simplicity of construction may be achieved by providing the complementary member on the laser apparatus side with a transparent core for conducting the energy to the input ends of the fibres.

In an advantageous arrangement, the fibres diverge at the output to a set of terminals which are adapted to be connected with the charges by further optical fibres. The arrangement is especially convenient if there is also provided a set of connectors engageable with the terminals to connect them with said further fibres. The coupling of explosive charges to the cable is then achieved by connecting the further fibres, provided each with a connector and leading from the charges, with the terminals. The terminals may be provided in an assembly already mounted upon the cable (eg. supplied therewith). The task of making access to the individual fibres under field conditions is thus avoided.

The further fibres may be of greater cross-sectional area than the fibres extending through the cable. Thus the further fibres (usually with a sheathing) can be selected for robustness and ease of handling as can the multiple-fibre cable. The latter can be formed from commercially available stock (or off-cuts thereof) eg. stock intended primarily for data-transmission or other communication purposes.

According to one arrangement provided by the invention for detonating a series of explosive charges by means of a laser, the charges are fitted with detonators each of which terminates one end of a length of optical fibre and is constituted and arranged to be actuated by optical energy received from the laser via said length, the opposite end of the first of said lengths is connected with an optical supply line leading from the laser and having an attenuation per unit length for the laser energy which is substantially smaller than that of the said length, energy is passed from the laser to detonate the charge fitted with the detonator which terminates said first of said lengths, and the remaining charges are subsequently detonated in turn by connecting the remainder of the said lengths with said supply line and passing therethrough from the laser, the connection of the said lengths with the supply line being effected by interengaging connecting components.

In practice, the laser is readily selected to give in each pulse an amount of energy which is substantially greater than the total energy required to actuate a set of detonators simultaneously. Because there is a surplus of energy available, loss can be tolerated at the interengaging components and arrangements made for dividing the energy between the detonators of a set need not be of such a precision design as to divide the energy into sensibly equal amounts.

The arrangement is usually applied to blasting operations in which sets of explosive charges are detonated in turn, usually with intervals between the detonations of the sets occupied by such site work as the clearance of rubble and the drilling of shot holes. Each explosive charge of the series aforesaid is one from a number of sets of charges to be detonated in turn and the lengths of fibre associated with the charges of a set are connected with the supply line simultaneously. It is advantageous to connect the lengths of fibre with the supply line via intermediate lengths of fibre.

The detonation of the charges damages the lengths of fibre terminating at the detonators. These lengths are therefore expendable and forming them of fibre having an attenuation which is high compared with that of the supply line from the laser contributes to the economy of the method. It cannot be predicted how far damage to fibres will extend and in a preferred arrangement the lengths of fibre and said intermediate lengths are renewed when damaged. With this arrangement the lengths of fibre terminating at the detonators and discarded after a set of charges has been fired can be provided in a length which is economic in the value of the optical fibre necessarily expended and in the packaging, transport and storage of detonators with the lengths of fibre attached.

The intermediate lengths of fibre may have an attenuation per unit length for the laser energy which is high in comparison with that of the supply line. They may be formed of the same material as the lengths terminating in the detonators.

A detonator for laser actuation advantageously has, adjacent to the end face of its length of optical fibre, a body of flashing composition.

Flashing compositions are well known in the explosives art, eg. for coating the bridgewire used at the fusehead in electrical detonating systems. Connecting a set of fuseheads with an adequate source of electric power is a simple matter, the efficient jointing of the wiring to give the required series or series-parallel circuit being readily accomplished in the field.

Unlike a wire used for the transmission of electrical energy, an optical fibre transmitting laser energy will deliver an output only in the direction of, and close to, its major axis. To be usefully employed the delivered energy must be intercepted, otherwise it is lost by transmission through the atmosphere which is a conducting medium for laser energy but an insulator for electrical purposes.

A detonating device of superior performance, provided by the invention comprises a length of optical fibre which terminates in a transverse end face and, adjacent to the end face, a body of a flashing composition of which the active material is selected from the mono- and di-nitro resorcinols and their salts, and the mono- and di-nitroso resorcinols and their salts and mixtures of two or more of these active substances. With such a detonating device the detonation of charges for a given amount of laser output energy is obtained in an especially reliable manner permitting the use in the transmission channel of cheap non-precision connecting components and of fibres having attenuation properties which are unsuitable for communication purposes all with consequent economic advantages.

In practice, the body of the flashing composition is preferably formed of the flashing material found into a coherent form by the resinous binder, the most favoured binder being a nitrocellulose. Arrangements in which the body is in the form of a powder confined in a cell into which the fibre projects are possible.

One convenient arrangement is to provide the body in the form of a coating applied at least to the transverse end face of the fibre. Usually, and especially when the coating is produced by applying a mixture of the active material, a resinous binder and a volatile solvent, the coating extends over a region of the longitudinal (usually cylindrical) surface of the fibre contiguous with the end face. Dipping the end of the fibre into the mixture is the most convenient method of applying the mixture. By covering the coating with a lacquer, the coating is strengthened and protected for handling purposes and stabilised for storage.

In another arrangement, the end part of the length of optical fibre is fitted with a fibre locating component formed with a bore dimensioned to locate said end part, the fibre extending into the bore from one end thereof and the said body being exposed in the region of the other end thereof. With this arrangement, the body may be applied to the transverse end face after the fibre has been fitted to the fibre locating component. It may be located relative to the end face by the fibre locating component, eg. the fibre locating component may be provided with a recess into which the body is introduced in the form of a paste.

The timing of the firing of the individual blasting charges to produce a sequence is usually produced by providing each charge, except perhaps the first to be fired, with an appropriate amount of a delay composition. It is within the scope of the invention to provide the fibre-locating component aforesaid with a channel which communicates with said body and is filled with a delay composition.

For most purposes, the detonating device is conveniently provided as part of a fusehead assembly from which the length of fibre extends for connection with the laser system and which can be applied in detonating relationship with the charge to be fired as in electrical detonation. Especially with this arrangement, the body may be held by a body holder formed separately from the fibre locating component. In most practical cases, the fibre locating component is best provided in the form of a closure member, eg. a bung-type closure member for the fusehead. The body holder can then be inserted in the fusehead before the closure member is fitted.

BRIEF DESCRIPTION OF THE DRAWINGS

In the accompanying drawings which are given in order to illustrate the invention by reference to preferred embodiments.

DESCRIPTION OF THE PREFERRED EMBODIMENTS

Figure 1:
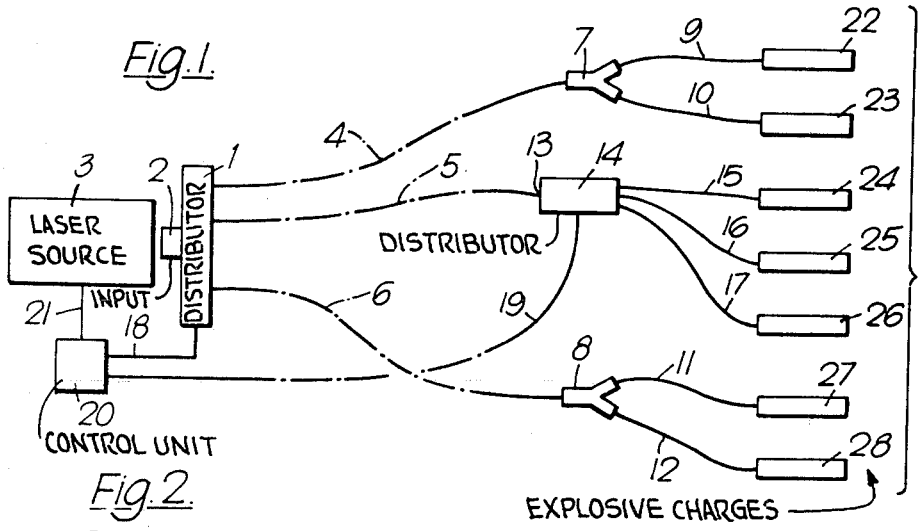
FIGS. 1, 2 and 3 show the general layout of example of systems according to the invention.

In the system of FIG. 1 a mechanically actuated distributor 1 has an input 2 for receiving pulses of energy from a laser source 3. Energy from the inputs is passed by the distributor in turn to a series of optical transmission fibres 4, 5 and 6. Fibres 4 and 6 terminate in branching connections 7 and 8, each of which connects with a pair of fibres, 9 and 10, and 11 and 12 respectively. Fibre 5 terminates at the input 13 of a mechanically actuated distributor 14 which provides outputs to fibres 15, 16 and 17 in sequence.

The mechanical actuation of distributors 1 and 14 is by a stepwise mechanism which is advanced one step at a time, as required, by electrical signals received by electrical connections 18 and 19 from a control unit 20 which also so controls the laser source 3, via connection 21, that the laser pulses are synchronised with the said actuation.

Explosive charges 22 to 28 are connected in operative relationship with fibres 9, 10, 15, 16, 17, 11 and 12 as shown. Charges 22 and 23 are first exploded simultaneously. As distributor 1 is advanced charges 24, 25 and 26 are exploded in sequence and charges 27 and 28 are then exploded simultaneously. The result is a five stage sequence. Two charges are exploded together in the first and fifth stages and a single charge is exploded in the second, third and fourth stages. A system of this kind is useful, for example, where a sequential firing pattern is required but the particular circumstances render it difficult to distribute a set of single charges as required.

Figure 2:
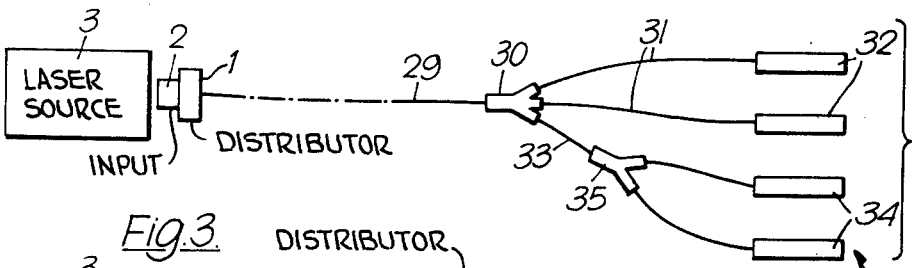

The system of FIG. 2 has a single fibre 29 supplied by input 2 and running to a three way branching connection 30 which distributes the energy between a pair of fibres 31, communicating with charges 32, and a third fibre 33 which connects with another pair of charges 34 via a two way branching connector 35. With this system, the four charges 32 and 34 are fired simultaneously.

Figure 3:
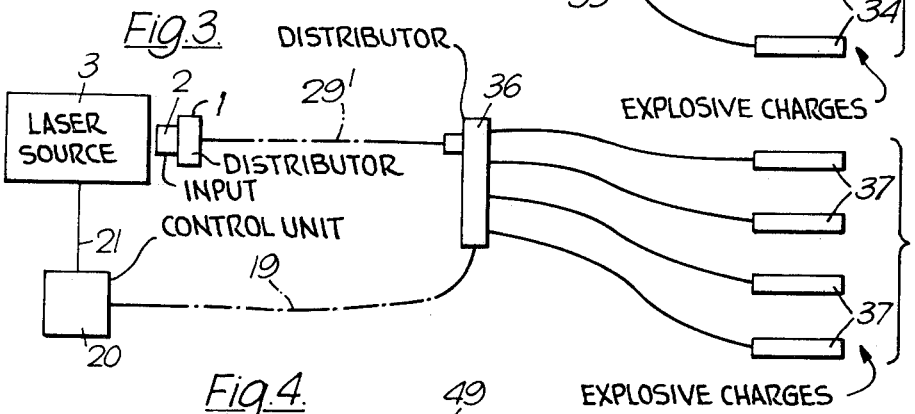

In the system of FIG. 3, a single fibre 29′ supplied by input 2 terminates at a mechanical distributor 36 which is actuated by signals from control unit 20 to fire charges 37 in sequence.

Fibres 4, 5, 6, 29 and 29′, and the electrical connections 19 of the systems of FIGS. 1 to 3 can run over the major part of the distance from the laser source 3 at the control site to the blasting site.

Figure 4:
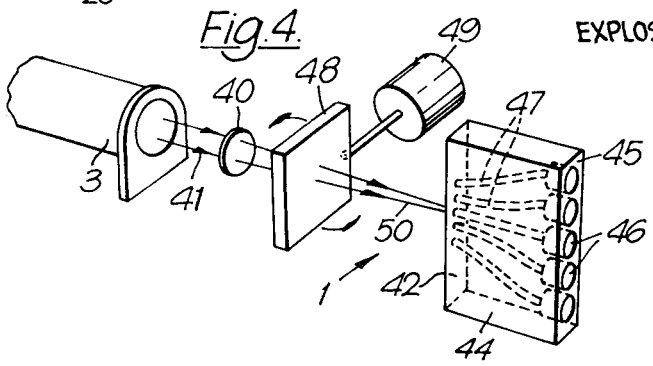
FIG. 4 shows an example of a distributor for mechanical actuation.

The distributor 1 of FIG. 1 may be in the form shown in FIG. 4. A lens 40 focuses parallel beam 41 from the laser source 3 to the position of the edge 42 of a block 44. Opposite edge 45 of the block is formed with a set of sockets 46, the inner ends of which communicate via embedded fibres 47, or internal reflecting channels, with edge 42. A block of transparent material 48 rotated by an electric stepping motor 49 intercepts the convergent beam 50 and moves the point of focus along the edge 42 so that the laser energy is transmitted to the sockets 46 in turn.

Figure 5:
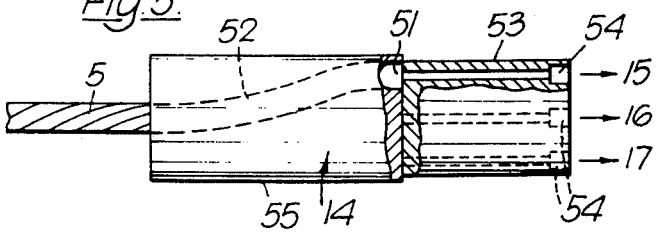
FIGS. 5 and 6 show another example of such a distributor.
Figure 6:
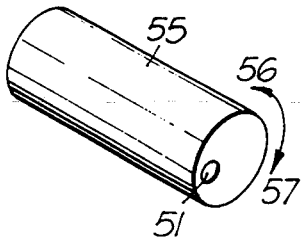

FIG. 5 shows a suitable form for the distributor 14. Fibre 5 communicates with the centre of one end of a cylindrical rotor 55 having an internal reflecting passageway 52 extending to an eccentric position 51 at the opposite end. Adjacent to this opposite end is a cylindrical block 53 formed with internal passageways for bringing passageway 52 in turn into communication with sockets 54 for the reception of 15, 16 and 17. A solenoid device (not shown), energised via line 19 is provided for actuating the rotor in a forward, firing, direction 56 and a return direction 57.

Figure 7:
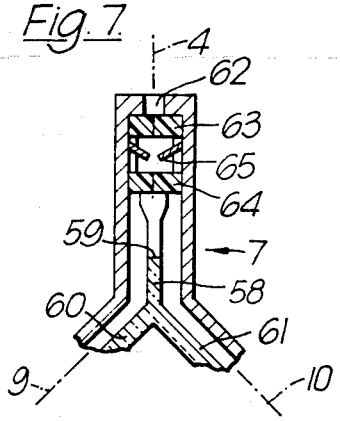
FIGS. 7 and 8 show examples of branching distributors.

The two-way branching distributor 7 of FIGS. 1 and 7 has a Y-shaped internal piece 58 of transparent material. Laser energy received at its end 59 is intercepted by both of the branches 60 and 61 to give two outputs, one for each of fibres 9 and 10. Connection with fibre 4 is made simply by pushing it through end aperture 62 and perforated diaphragms 63 and 64, of elastomeric material, until its end touches, or nearly touches end 59. An apertured conical diaphragm 65 grips the fibre and prevents its withdrawal. Similar arrangements, not shown, are provided for connecting fibres 9 and 10.

It is of little consequence if the ends of the fibres are directed non-axially even though this may cause unequal outputs to fibres 9 and 10 and/or energy losses.

Figure 8:
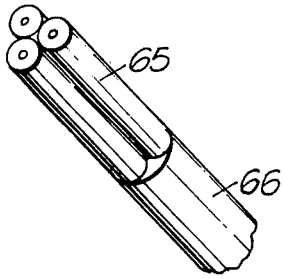

FIG. 8 shows one end of a branching distributor having three outputs 65. An appropriate branching connector is housed in body part 66.

Figure 9:
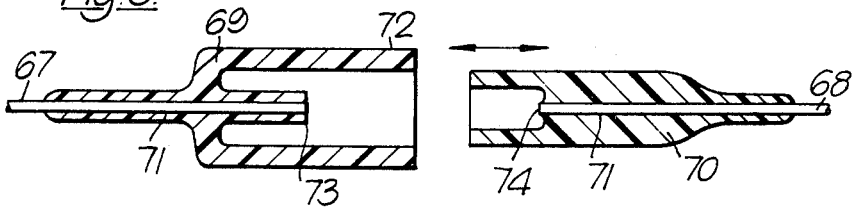
FIGS. 9, 10 and 11 show examples of optical fibre connectors.

The connector shown in FIG. 9 is intended for joining the ends of two fibres 67 and 68. It consists of two complementary parts 69 and 70 moulded from elastomeric material. Each has an axial channel 71 for gripping the fibre. The outer diameter of part 70 is an interference fit with the inner diameter of skirt part 72 of part 69 and when part 70 is fully inserted the inner axial projection 73 abuts the interior of part 70 at 74.

Figure 10:
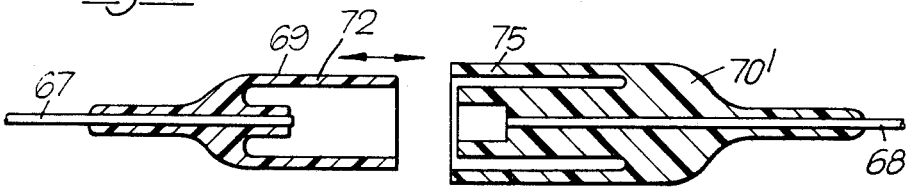

The connector shown in FIG. 10 is more elaborate in that part 70′ has an external skirt portion 75 defining a deep annular recess for the reception of skirt part 72 of part 69.

Figure 11:
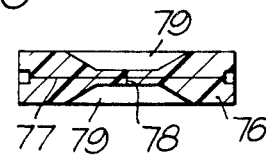

A more simple connector is shown in FIG. 11. A moulded elastomeric body 76, has an axial channel 77 for the reception of the ends of two fibres at 78. Externally, its mid portion is narrowed and formed with integral ribs 79. The arrangement gives a flexibility which facilitates insertion of the fibres and yet maintains an adequate gripping action.

Figure 12:
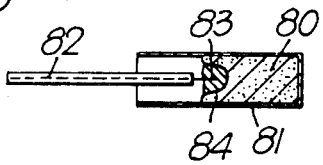
FIG. 12 shows an optical fibre connected with a detonator.

In FIG. 12 there is shown a detonator having an explosive composition 80 contained in, and partly filling a tube 81. Fibre 82 enters the tube and has its end embedded in the explosive at 83. The portion 84 of the explosive is preferably coated upon the end portion of fibre 82 and embedded in the remainder of the explosive together with the fibre. Portion 84 need not be of the same composition as the remainder. It may contain a dyestuff or pigment to promote absorption of the laser-derived energy.

Figure 13:
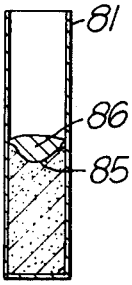
FIG. 13 shows a detonator having a phosphorescent or reflecting material for system testing purposes.

FIG. 13 shows a detonator, also consisting of a partly filled tube 81. The boundary 85 of the filling 80 is coated with a phosphorescent composition 86 for optical testing of the installation as hereinbefore described.

Figure 14:
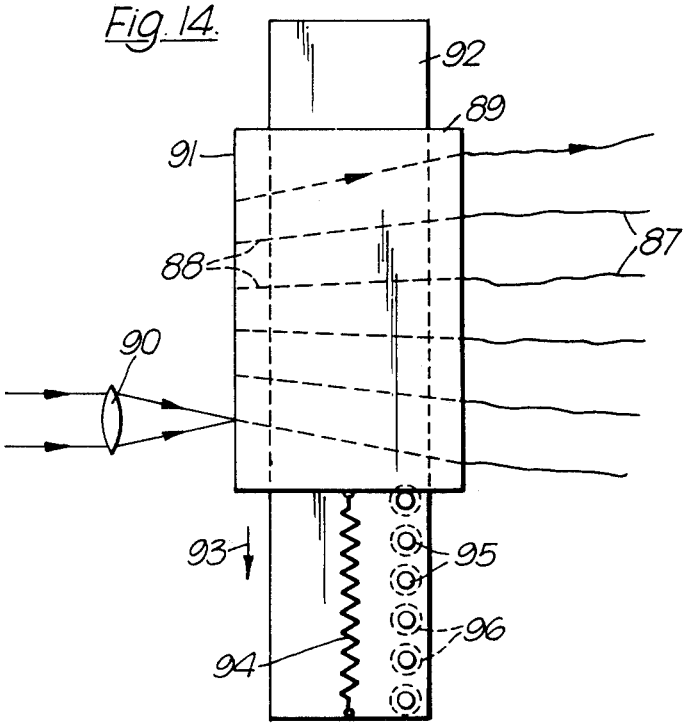
FIG. 14 shows another example of a distributor for mechanical actuation.

FIG. 14 shows another form of mechanically actuated distributor. The fibres 87 are connected by plug and socket connection (not shown) with transmission passageways or embedded fibres 88 of a block member 89. A lens 90 focuses the laser energy into the passageways or fibres 80 at face 91 of the block.

Block 89 is mounted upon a track 92 and biassed in direction 93 by a tension spring 94. At positions which correspond with the reception of energy by passageways or fibres 88, the track 92 is provided with stops 95 retractable in turn by the energisation of solenoids 96. Actuation of the laser and the solenoids is under the control of a common actuating circuit.

Figure 15:
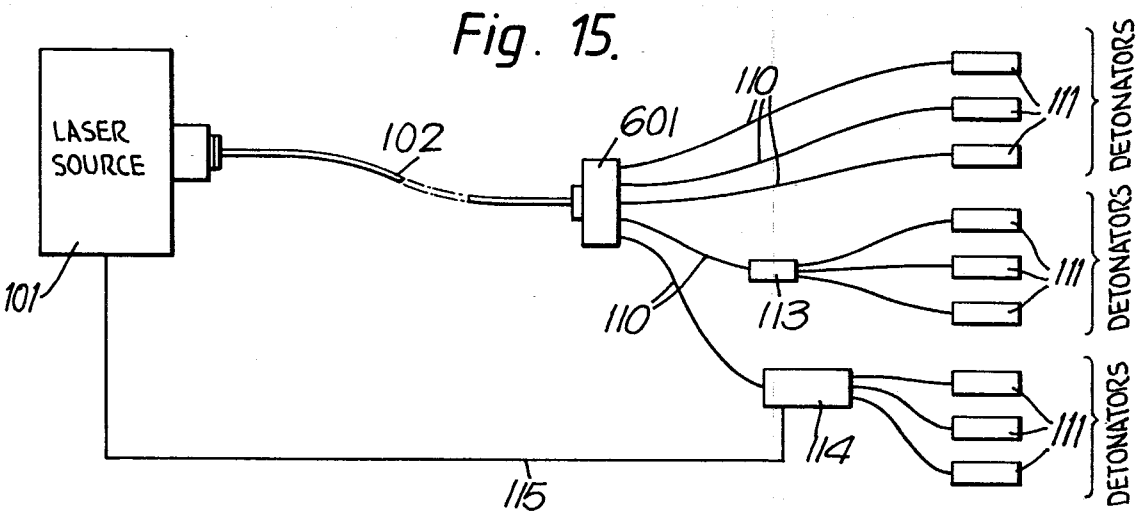
FIG. 15 is a diagrammatic drawing showing another system according to the invention.
Figure 16:
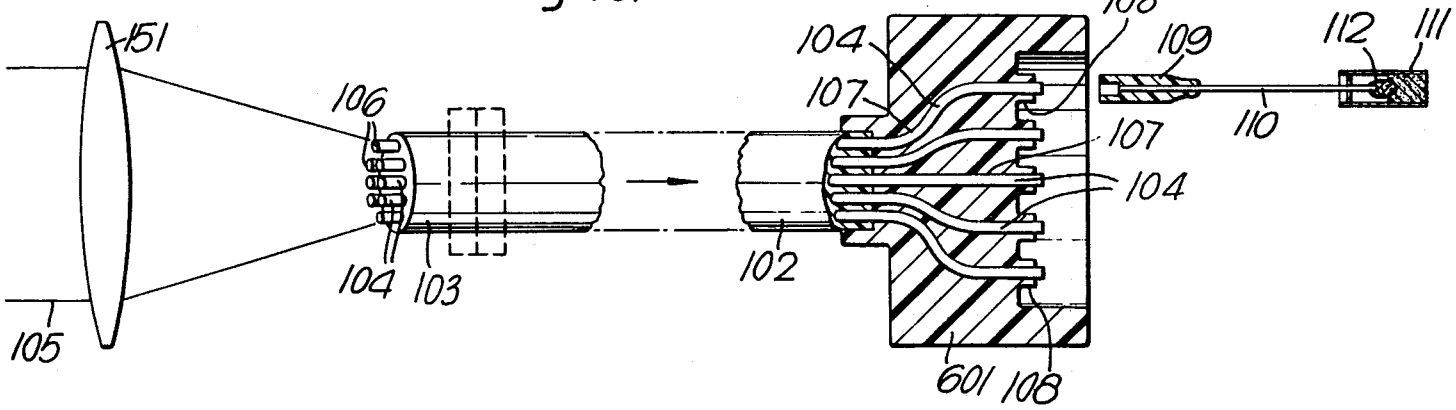
FIG. 16 shows parts of the system of FIG. 15 in detail.

In the system of FIGS. 15 and 16, a laser and associated circuitry housed in cabinet 101 supplies optical pulses of laser energy to a multicore cable 102 having an outer sheating 103 and a close-packed set of six optical fibres 104.

The pulses are generated in the form of a parallel beam 105 which is converted by a convex lens 151 to a beam convergent on to the ends 106 of fibres 104. A major proportion of the energy enters the fibres through ends 104 but some is lost between and around the fibres.

The function of the lens 151 is to reduce the cross-sectional area of the beam. Its spacing from the ends 106 of the fibres is so arranged that the area is reduced as required and the ends 106 could be positioned beyond the focal distance, and so exposed to a divergent beam if required. Lens 151 is usually of the spherical type. A lens or combination of lenses having a cylindrical component may be employed where the ends 106 form a substantially non-circular reception zone.

The energy passes along the fibres to connector 601 in which the fibres diverge through pre-formed channels 107 (or channels produced by moulding connector 601 around the fibre) to emerge through terminal formations 108. These formations have cylindrical outer surfaces upon which can be fitted sockets 109 to link a set of preferably sheathed single fibres 110 leading to the detonators 111. The ends of fibres 110 may be coated with an explosive composition 112 to facilitate detonation. A pigment or dyestuff may be included in composition 112 to facilitate absorption of the laser energy.

Figure 18:
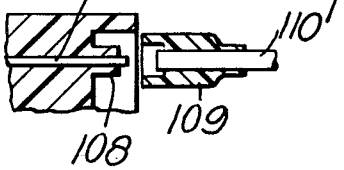
FIG. 18 shows another modification of the system of FIG. 15, FIGS. 19 to 24 respectively show six different embodiments of the invention in which the detonator end of the fibre or fibres is/are in contact with a flashing composition, and FIGS. 25A, B and C show embodiments of the invention in which detonators are provided with lengths of optical fibre terminating in optical plugs to provide an expendable arrangement.

Good reliable detonation is readily obtainable with the system. FIGS. 15 and 16 show fibres 110 which are of the same gauge as the fibres 106. Substantially thicker fibres 110' may be used when desired—see FIG. 18.

The energy supplied to fibres 110 may be more than sufficient to produce reliable detonations. A plurality of charges may be exploded simultaneously by providing branching connectors, such as 3-way connector 113 shown in FIG. 15. Connector 113 may be of simple internal construction as it is not necessary to avoid loss of energy or to ensure that precisely equal amounts of energy are passed to the three branches. Where it is desired to fire charges in sequence, a distributor 114 having optical parts movable in response to electrical signals supplied from the laser circuit such as by line 115 of FIG. 15 may be provided to produce a sequential effect.

It must be noted that the arrangement of six or seven simultaneous firings, plus sequential firings, is shown in FIG. 15 for purposes of illustration and its use in practice is likely to be uncommon.

Figure 17:
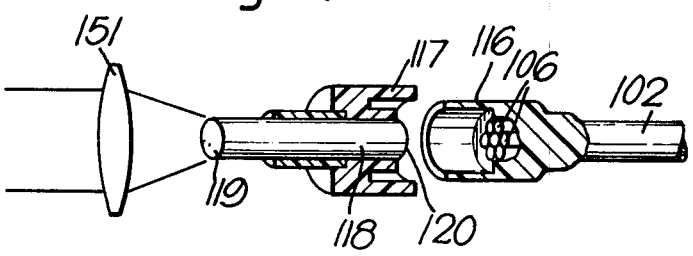
FIG. 17 shows a modification of the system of FIG. 15.

In the modification shown in FIG. 17, a plug and socket arrangement 116, 117 is employed for quick and easy connection of the multicore cable 102 with the laser apparatus. Socket part 117 is provided with a single fibre or rod 118 of light transmitting material and the lens 151 converges the energy on to end face 119 thereof. The energy transmitted leaves by end face 120 to be received by the ends 106 of the fibres in cable 102.

Cable 102 in the system shown is typically 100 meters in length.

An example of a laser used with the systems of FIGS. 15 to 18 has a neodymium doped yttrium aluminium garnate laser rod of active length 30 mm. and diameter 3 mm., with resonating mirrors deposited directly upon its ends. The rod and a 40 to 60 watt flash tube are mounted along the focal lines of a common eliptical cavity. A 700 $\mu$F capacitor having a stored energy of 40 Joules provides the power for the flash tube. The laser output pulse is 0.5 Joules over 2.5 milli-seconds with a wavelength of 1.06 $\mu$m.

This laser was used with a cheap lens, 151, of from 10 to 20 mm. focal length and with a cable 102 having a number of silicon coated fibres cores of 0.3 mm. diameter and an outer sheathing of polyvinyl chloride. The loss characteristic of the cable was 20 dB per kilometer.

The cable was simply cut for use as required, no polishing of the ends of the fibres being necessary.

Figure 19:
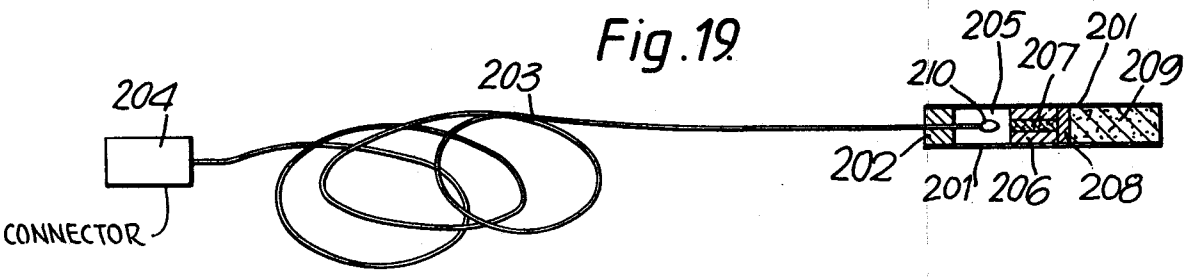

In the embodiment of FIG. 19 a housing 201 in the form of an aluminium tube is sealed at one end with a bung 202 of elastomeric material. An optical fibre 203 leading from a connector 204 for connecting it with a laser extends through bung 202 as shown into space 205. Typically, the optical fibre is a silica fibre of 0.2 mm diameter sheathed with a layer of silicone rubber and having an attenuation of 26 dB/km. Any external abrasion-resistant classing is preferably a cheap cladding of the extruded type. Like the detonating device itself, the fibre is expendable.

Beyond space 205 is a tubular insert 206 filled with a conventional delay composition 207 followed, as in conventional practice, with a filling 208 of lead azide and a further filling 209 of pentaerithritol tetranitrate (PETN).

The end part of fibre 203 projecting into space 205 carries a coating 210 of mononitroresorcinol in the form of a lead salt bound by a nitrocellulose binder. This composition has been applied by dipping the end of the fibre, after insertion through bung 202, into a fluid mixture of the two components and acetone or other solvent for the binder, drying and coating with a cellulose lacquer.

A pulse of laser energy received along the fibre is absorbed by coating 210 where it covers the end face of the fibre. The lead salt ignites to form a flame of exothermically reacting matter which impinges on, and ignites the delay composition 207. Detonation of a charge to which the fusehead is applied is thereafter produced in a conventional manner.

Figure 20:
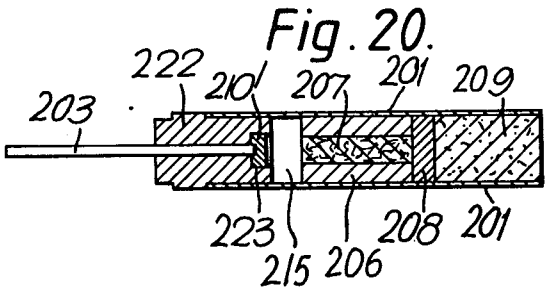

The embodiment of FIG. 20 is generally similar to that of FIG. 19. However, instead of plug 202, the tube 201 is fitted with a bung 222 having a recess 223 formed in its end face. The end of fibre 203 extends into the recess where it is embedded in the subsequently applied body 210' of the lead salt and binder.

Figure 21:
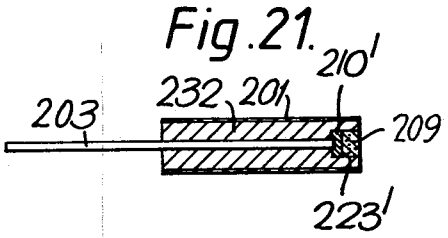

FIG. 21 shows an embodiment for application where no delay composition 207 is required. In this case the bung 232 is long compared with bungs 202 and 222. The end part of recess 223' is filled with a small quantity of detonator composition for detonating the charge.

Figure 22:
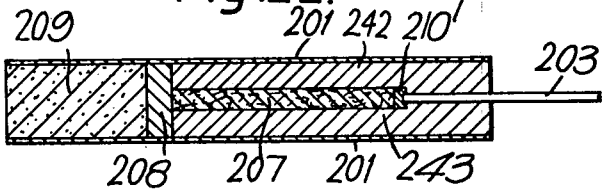

The embodiment of FIG. 22 employs, instead of the bung 222 and the insert 206 of FIG. 20, a combined component 242 in which the delay composition 207 is filled into a bore 243 which is contiguous with the entrance passageway for fibre 203.

Figure 23:
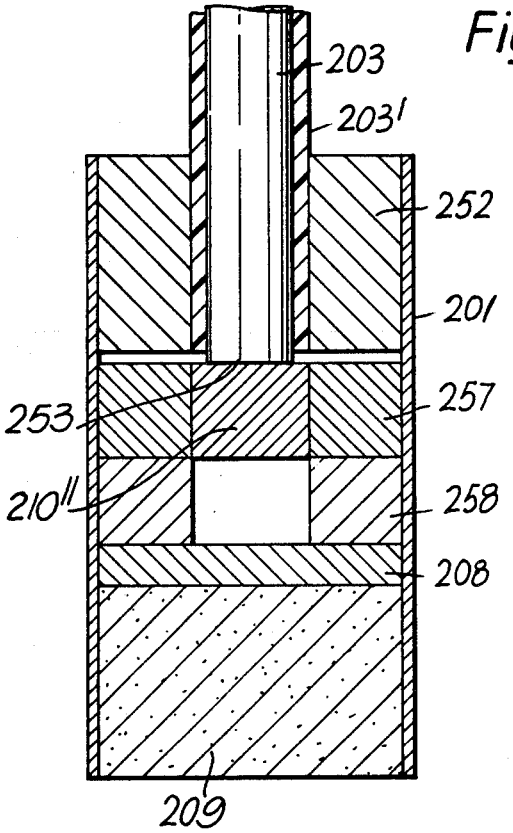

In the embodiment of FIG. 23, the fibre 203 (here shown with a silicone rubber coating 203') extends through bung 252 to project therefrom at 253. The flashing composition (dinitroresorcinol) 210'' is provided separately in the form of a filling contained in the centre of an annular plug insert. With this arrangement of providing an insert containing the flashing composition as a separate component assembly of the fusehead is achieved more rapidly after cutting the fibre from stock than with the embodiments of FIGS. 19 to 22.

Insert 258 is an annular spacer which provides a gap between the flashing composition 210'' and layer 208 of lead azide.

Figure 24:
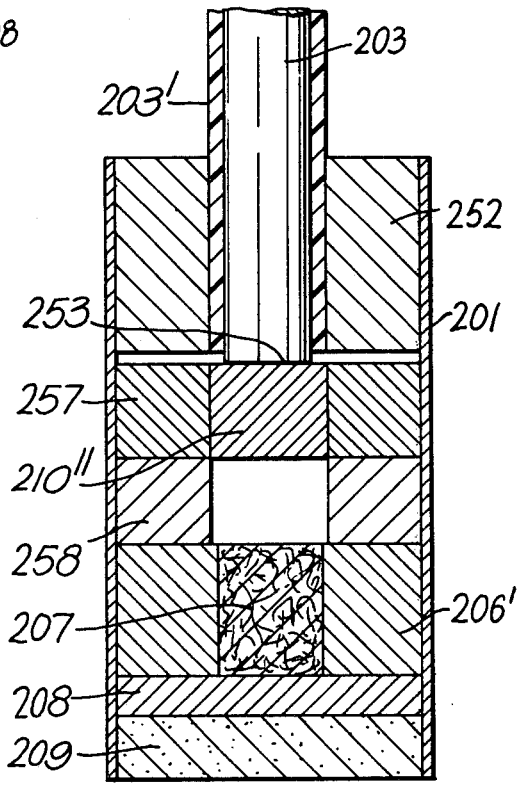

The embodiment of FIG. 24 is a modification of that of FIG. 23 in which a delay composition 207, held in an annular insert 206', is positioned between the insert 258 and the layer 208.

Used as a flashing composition as described herein, a nitro or nitroso-resorcinol can be activated with as little as 20 to 50 millijoules (mJ) of received laser energy. The sensitivity is of the same order as potassium chlorate, but potassium chlorate is much less stable under storage conditions. A laser giving an output of from 500 to 600 mJ per pulse, eg. a pulse of one millisecond, presents no design problems and with such a laser transmission losses in the fibres and at their connections are readily tolerated.

Figures 25A, 25B, 25C:
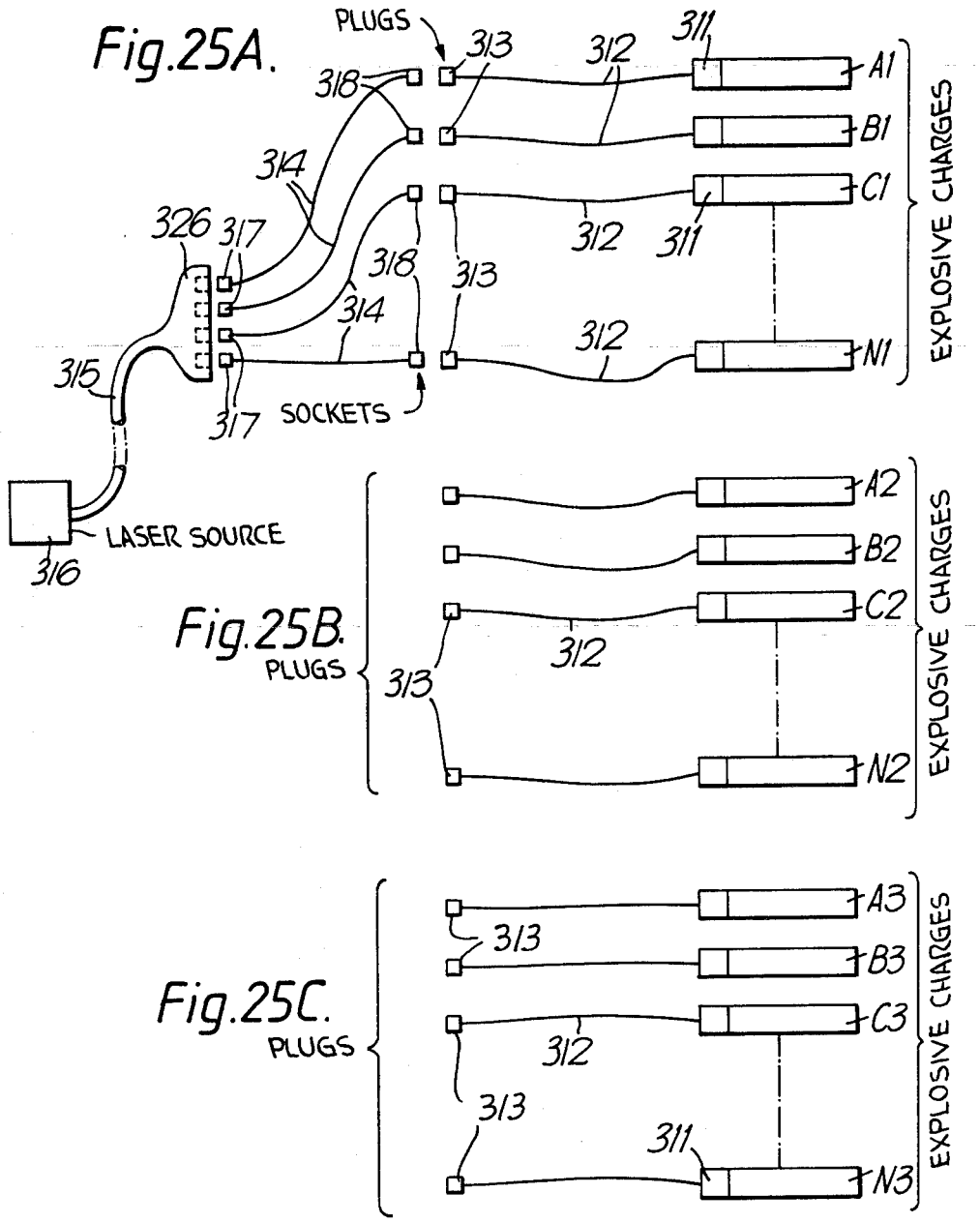

FIGS. 25A, B and C show three sets A1, B1, C1 . . . N1; A2, B2, C2 . . . N2; and A3, B3, C3 . . . N3 of charges to be detonated in turn. Each charge is provided with a detonator 311 which terminates a length of optical fibre 312. The detonators and their fibres may be as described in FIGS. 19 to 24. An example of a suitable fibre is silica fibre of diameter 0.2 mm sheathed with silicone rubber and an outer protective layer. Such a fibre has an attenuation of 26 dB/Km at a typical laser energy wavelength. Typically each length is 10 to 15 meters from end to end.

All the charges are shown in association with their detonators and fibres but, in practice, it is usual to fit them to each set only when it is being prepared for detonation.

At the ends remote from the detonators, the fibres 312 are fitted with plugs 313.

To fire a set of charges, the associated fibres are connected by intermediate lengths of fibres 314 with an optical supply line 315 leading from a laser device 316 to a multiple output socket 326 by inserting plugs 317 therein. A plug 317 may be common to two or more fibres 314 as shown. Connection of fibres 312 and 314 is made by inserting plugs 313 into sockets 318. These plugs and sockets may be as described with reference to FIG. 9 or 10.

Fibres 314 may be of the same specification as fibres 312. Supply line 315, which is required to convey the energy from the laser 316 located at a safe distance from the blasting site, is a heavily sheathed cable having an attenuation of, say, 5 dB/Km. Its cost per unit length can be as much as 100 times that of fibres 312 and 314.

A preferred arrangement for the laser 316, supply line 315, and output socket 326, is described with reference to FIGS. 15 through 18.

When set A1 . . . N1, shown connected in the drawing, has been detonated, the fibres 314 are inspected and those damaged by debris are replaced, together with their plugs 317 and sockets 318, from stock. After the necessary site work, the next set A2 . . . N2 is prepared for detonation by inserting the plugs 313 thereof into the sockets 318, some of which may have been replaced together with their associated fibres 314.

Set A3 . . . N3 and any further sets are detonated after a similar procedure.

Reference has been made hereinbefore to the firing of a series of charges in turn. It will be appreciated that an output point of multiple output socket 326 is employed for this purpose, the members of the series being taken in turn, one from each of the sets which is to be detonated simultaneously. It will also be appreciated that a plurality of series is detonated during a given time period and that the members for a particular series do not have to be identified in advance. They can be taken at random during the overall operation.

It is to be understood that the method and apparatus described with reference to the drawings hereof can be varied to suit particular circumstances. The number of charges need not be the same in every set and the equipment can be chosen with reference to its availability once the principles of the invention have been understood.

By the present invention the safety of shot firing by means of a laser is obtained in a simple and economic manner.

I claim:

1. A system for connecting a set of explosive charges with a laser for detonation by optical energy from the laser which comprises an input for optical energy produced by the laser, a set of optical fibres for connection one with each of the charges and distributor means for distributing optical energy from the input to the fibres of said set, said fibres having longitudinal axes and said distributor means being operable to receive energy from the laser and to direct a part of the received energy into the fibres and to direct the remainder of the received energy to waste, at least a substantial proportion of the part directed into the fibres being directed non-axially so that the propagation of said at least a substantial proportion through the fibres is by zigzag paths.

2. The system of claim 1 wherein said distributor means is located at said input so that the distribution is effected at said input.

3. The system of claim 1 having an optical fibre connecting said input with said distributor so that the distribution is effected at a position remote from said input.

4. A system according to claim 1 in which the optical fibres of the set are connected with the distributor means by plug connections.

5. The system of claim 1 having plug connections whereby the optical fibres of the set are connected with the distributor means.

6. The system of claim 3 wherein the distributor means has a branched member formed of material which is transparent to the energy, said member having an input section which branches to provide a plurality of output sections, the arrangement being such that energy from the input section is intercepted by and transmitted along the output sections.

7. The system of claim 3 wherein said distributor has an intermittent mechanical drive of the solenoid actuated type.

8. The system of claim 1 wherein the distributor has an intermittent mechanical drive and the laser has actuating circuit means operable to actuate said laser to give pulses as output, and said drive and said circuit means are synchronised so that members of said set are connected with said input in a sequence such that they receive successive pulses from the laser in turn.

9. The system of claim 1 having a mechanically driven optical distributor in the form of a driven rotor having an optical path leading from an axially positioned input to an eccentrically positioned output, and output connections positioned to communicate with said output in turn as the rotor is rotated.

10. The system of claim 1 having a mechanically driven optical distributor in the form of a set of optical outputs mounted by a movable member which is movable to align said outputs successively with an optical input.

11. The system of claim 10 wherein the movable member is constituted to provide a set of optical pathways which diverge from one another in the direction of the optical outputs.

12. The system of claim 1 having a mechanically driven optical distributor provided with a mechanically movable member operable, on its mechanical movement, to deflect laser energy from a fixed input to a plurality of fixed outputs in turn.

13. The system of claim 1 wherein the optical fibres have terminal ends embedded in the explosive charges.

14. The system of claim 1 hwerein the optical fibres have their terminal ends in communication with a phosphorescent material positioned to receive and be actuated by optical energy received through the fibres.

15. A detonating device for detonating an explosive charge by energy from a laser, said device comprising a length of optical fibre which terminates in a transverse end face and adjacent to the end face, a body of a flashing composition in the form of an active material and a resinous binder, said active material being selected from the group of substances consisting of silver azide, the mono- and di-nitro resorcinols and their salts, and the mono- and di-nitroso resorcinols and their salts and mixtures of at lesat two of these substances, said composition being bound into a coherent form by said binder.

16. The device of claim 15 wherein the resinous binder is a nitrocellulose.

17. The device of claim 15 wherein the body of the flashing composition is a coating applied at least to said transverse end face.

18. The device according to claim 17 wherein the coating is covered with a lacquer.

19. The device of claim 15 wherein said length of fibre has an end part which terminates in said face and said end part of the length of optical fibre is fitted with a fibre locating component formed with a bore dimensioned to locate said end part, the fibre extending into the bore from one end thereof and said body being exposed in the region of the other end thereof.

20. The device of claim 19 wherein said body is located relative to said end face by the fibre locating component.

21. The device of claim 19 wherein said fibre locating component is formed with a channel which communicates with said body and is filled with a delay composition.

22. The device of claim 19 wherein said body is held by a body holder formed separately from the fibre locating component.

23. The device of claim 19 wherein said fibre locating component is provided in the form of a closure member for a detonator.

24. The device of claim 17 wherein said coating is produced by applying a mixture of the active material, a resinous binder and a volatile solvent for the resinous binder, to at least the end face of the fibre.

25. A method of detonating a series of explosive charges by means of a laser which comprises fitting the charges with detonators each of which terminates one end of a length of optical fibre and is constituted and arranged to be actuated by optical energy received from the laser via said length, connecting the opposite end of the first of said lengths with an optical supply line leading from said laser and having an attenuation per unit length for the laser energy which is substantially smaller than that of the said length, passing energy from the laser to detonate the charge fitted with the detonator which terminates said first of said lengths, and subsequently detonating the remaining charges in turn by connecting the remainder of the said lengths with said supply line and passing energy from the laser, the connection of the said lengths with the supply line being effected by inter-engaging connecting components.

26. The method of claim 25 wherein each explosive charge of the series is one from a number of sets of charges, which sets are to be detonated in turn, and the lengths of fibre associated with the charges of a set are connected with the supply line simultaneously.

27. The method of claim 25 wherein the lengths of fibre are connected with the supply line via intermediate lengths of fibre.

28. The method of claim 27 in which the intermediate lengths of fibre are connected with both the said lengths and the supply line by interengaging components.

29. The method of claim 28 wherein the intermediate lengths have an attenuation per unit length for the laser energy which is high in comparison with that of the supply line.

30. The method of claim 27 wherein each detonator has, adjacent to the end face of its length of optical fibre, a body of flashing composition of which the active material is selected from the group consisting of the mono and di-nitro resorcinols and their salts, the mono and di-nitro resorcinols and their salts and mixtures thereof.

31. A system for detonating a set of spaced-apart explosive charges which comprises an optical cable having a number of optical fibres extending through the cable from an input to the cable to an output from the cable and diverging from one another at the output for connection with separate ones of the spaced-apart charges, the fibres at the input having input ends positioned together in a reception zone, a laser apparatus for providing a laser beam distributed over the reception zone, the arrangement being such that the part of the laser energy of the beam intercepted by the input end of each fibre in the reception zone is sufficient for the detonation of at least one of such charges and, interconnecting the laser apparatus and the cable, a pair of complementary members of the plug and socket type, one mounted on the laser apparatus and the other on the cable.

32. The system of claim 31 wherein the laser apparatus has a lens for converging the beam upon the ends of the fibres.

33. The system of claim 31 wherein the complementary member mounted on the laser apparatus has a transparent core for conducting the energy to the input ends of the fibres.

34. The system of claim 31 having a set of terminals to which the fibres diverge at said output, said terminals being adapted to be connected with the charges by further optical fibres.

35. The system according to claim 34 having a set of connectors engageable with the terminals for connecting them with said further fibres.

36. The system according to claim 34 wherein said further fibres are of greater cross sectional area than the fibres extending through said cable.

* * * * *